US007426914B2

(12) United States Patent
Furuya

(10) Patent No.: US 7,426,914 B2
(45) Date of Patent: Sep. 23, 2008

(54) CRANKCASE OF AN ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/730,047

(22) Filed: Mar. 29, 2007

(65) Prior Publication Data

US 2007/0240672 A1 Oct. 18, 2007

(30) Foreign Application Priority Data

Mar. 31, 2006 (JP) ..... 2006-100006

(51) Int. Cl.
*F02B 75/22* (2006.01)

(52) U.S. Cl. ..... 123/195 R; 123/195 H

(58) Field of Classification Search ..... 123/73 R, 123/195 R, 195 H
See application file for complete search history.

(56) References Cited

U.S. PATENT DOCUMENTS 5,868,110 A * 2/1999 Betsch ..... 123/195 R
6,990,943 B2 * 1/2006 Koyama ..... 123/193.2

FOREIGN PATENT DOCUMENTS

JP 2002-242755 8/2002

* cited by examiner

*Primary Examiner*—Noah Kamen
(74) *Attorney, Agent, or Firm*—McGinn IP Law Group, PLLC

(57) ABSTRACT

A crankcase of an engine having a crankshaft therein comprises a skirt part formed in the circumferential direction of the crankshaft and a stiffening rib provided on a wall surface of the skirt part as inclined at a predetermined degree angle to the axis of the crankshaft.

19 Claims, 5 Drawing Sheets

CRANKCASE OF AN ENGINE

CROSS REFERENCE TO RELATED APPLICATIONS

This disclosure of Japanese Application No. 2006-100006 filed on Mar. 31, 2006 including the specification, drawings, and abstract is incorporated herein by reference in its entirety.

BACKGROUND OF THE INVENTION

1. Field of the Invention

The present invention relates to a crankcase of an engine, more particularly to a structure of a side wall of a crankcase.

2. Description of the Related Art

As is generally known, a force heading toward a cylinder head of an engine and a reaction force heading toward a piston are generated by an explosion power generated in a combustion chamber. The force heading toward the cylinder head operates to the crankcase through the cylinder head and cylinder bolts as a tractive force toward the cylinder head. On the other hand, the reaction force heading toward a piston operates to the crankcase through a connecting rod, a crankshaft and a bearing case as a tractive force downward. Therefore, the crankcase is required to have high stiffness from the standpoint of durability.

Meanwhile, it is strongly required to reduce a weight of an engine recently and it is desirable to reduce a wall thickness of heavy members such as a crankcase or the like so as to realize this weight saving efficiently.

A proposed crankcase has a curved skirt part having transversal ribs provided on the inner face thereof and extending in the axial direction of the crankshaft, and longitudinal ribs extending in a direction perpendicular to the crankshaft (see for example JP-A-2002-242755).

However, even if transversal ribs and longitudinal ribs are provided in lattice to improve a stiffness of the crankcase, it is only transversal ribs that contribute to improve the stiffness substantively against the force operating to the crankcase described above. In this case, the transversal ribs bends by bending force operating to the transversal ribs in up and down directions. Therefore, there is a limit to reduce the weight of crankcase with the sufficient stiffness of crankcase kept.

SUMMARY OF THE INVENTION

It is an object of the invention to provide a crankcase of an engine that achieves a weight reduction with a required stiffness kept.

According to a first aspect of the present invention, the crankcase of an engine having a crankshaft therein comprises a skirt part formed in the circumferential direction of the crankshaft and a stiffening rib provided on a wall surface of the skirt part as inclined at a predetermined degree angle to the axis of the crankshaft.

According to a second aspect of the present invention, the stiffening ribs are provided on the wall surface of the skirt part in different directions each other, and are arranged in lattice.

According to a third aspect of the present invention, the crankcase of an engine has a joint part provided on one side of the skirt part for connecting the skirt part with a bearing cover supporting the crankshaft, and an end of the stiffening rib is set at the same position as the joint part.

According to a fourth aspect of the present invention, an intersection point of the end of the stiffening ribs arranged in lattice is set at the same position as the joint part.

According to the first aspect of the present invention, since the skirt part has several stiffening ribs inclined to an axial of the crankshaft at a predetermined degrees angle, an impact of explosion transmitted to the crankcase through the crankshaft, can be efficiently dispersed by the skirt part so as to improve a stiffness of the crankcase. Consequently, it is possible to reduce a thickness of the crankcase and to achieve a weight reduction with a required stiffness kept.

According to the second aspect of the present invention, it is possible to disperse an impact of explosion, which is accepted by the crankcase through the crankshaft, on the skirt part more efficiently, and to improve a stiffness of the crankcase more efficiently.

According to the third aspect of the present invention, it is possible to disperse an impact accepted by the crankcase more effectively and to improve the stiffness of crankcase because of the stiffening ribs arranged in lattice especially.

According to the fourth aspect of the present invention, it is possible to disperse an impact transmitted from the crankshaft to the crankcase through the bearing cover, because of providing the end portion of the stiffening ribs at the same position as the joint part.

DETAILED DESCRIPTION OF THE PREFERRED EMBODIMENTS

Figure 1:
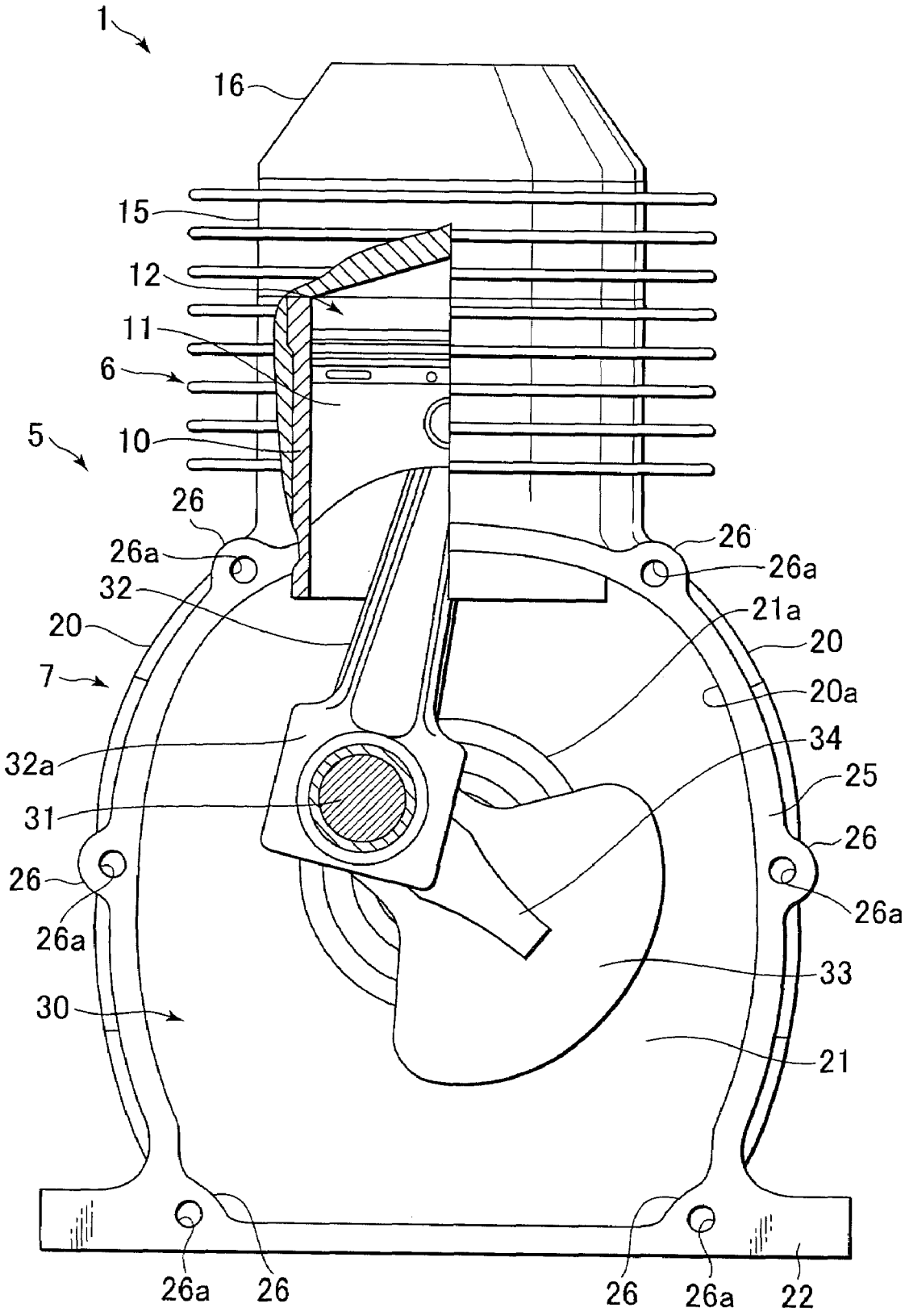
FIG. 1 is a configuration view of a crankcase with a bearing cover removed.
Figure 2:
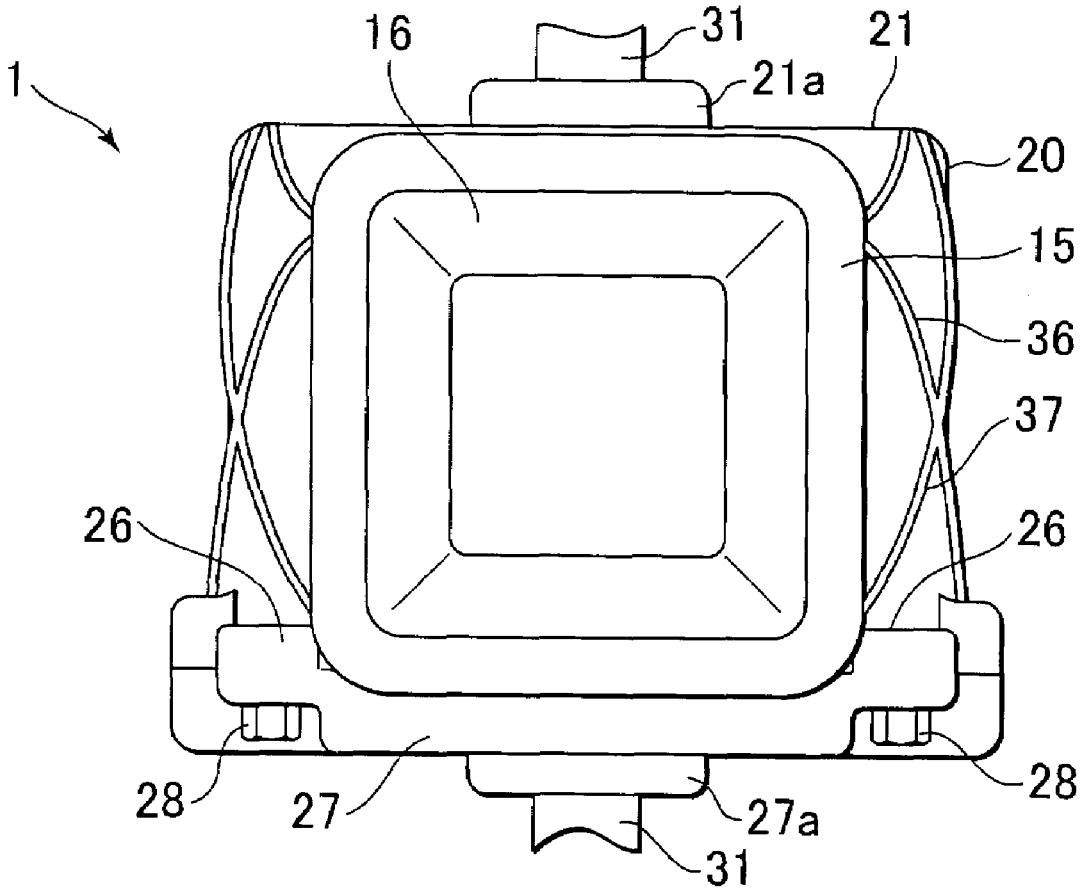
FIG. 2 is a top view of a crankcase with a bearing cover attached.
Figure 3:
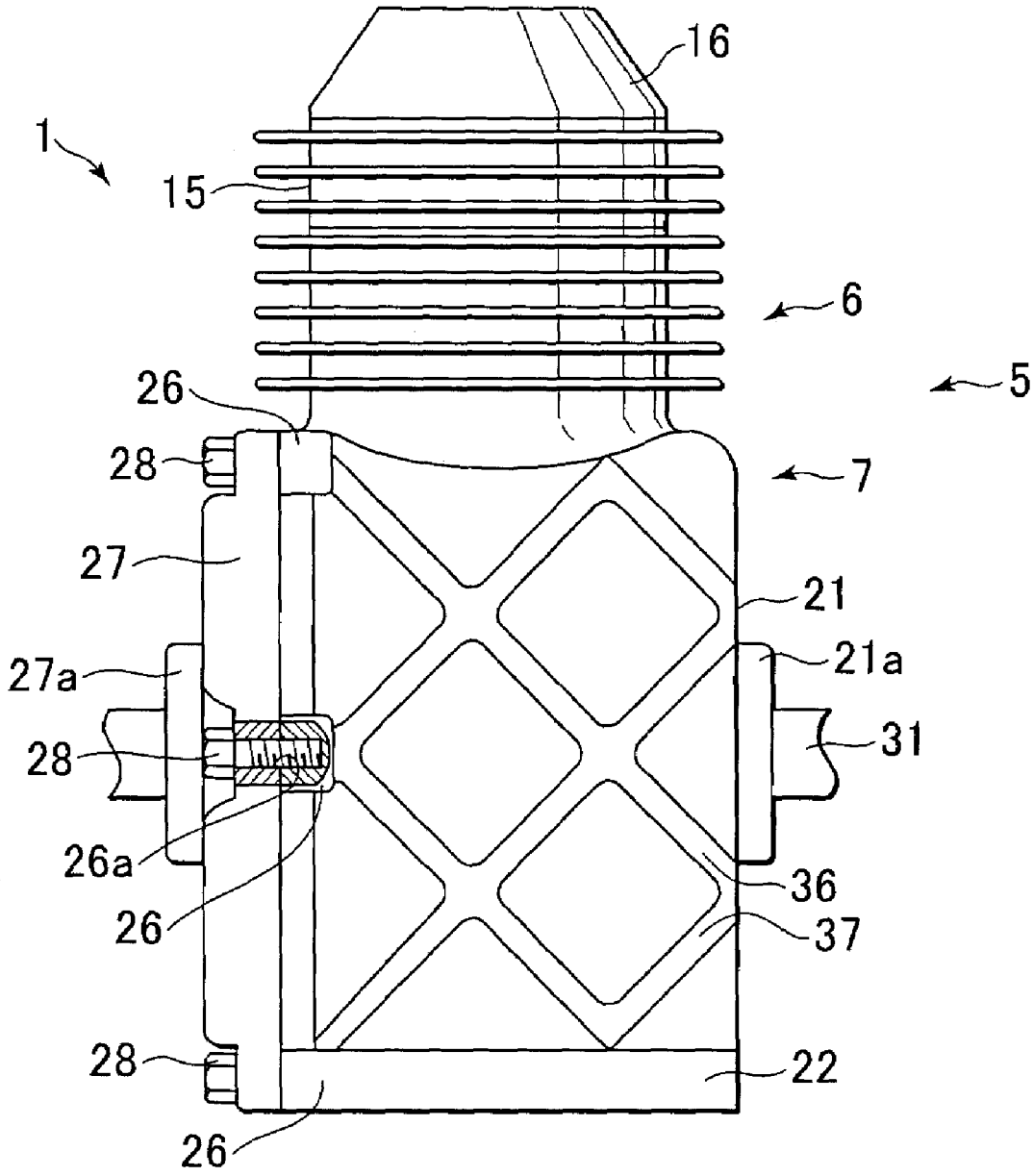
FIG. 3 is a one side view of a crankcase with a bearing cover attached.
Figure 4:
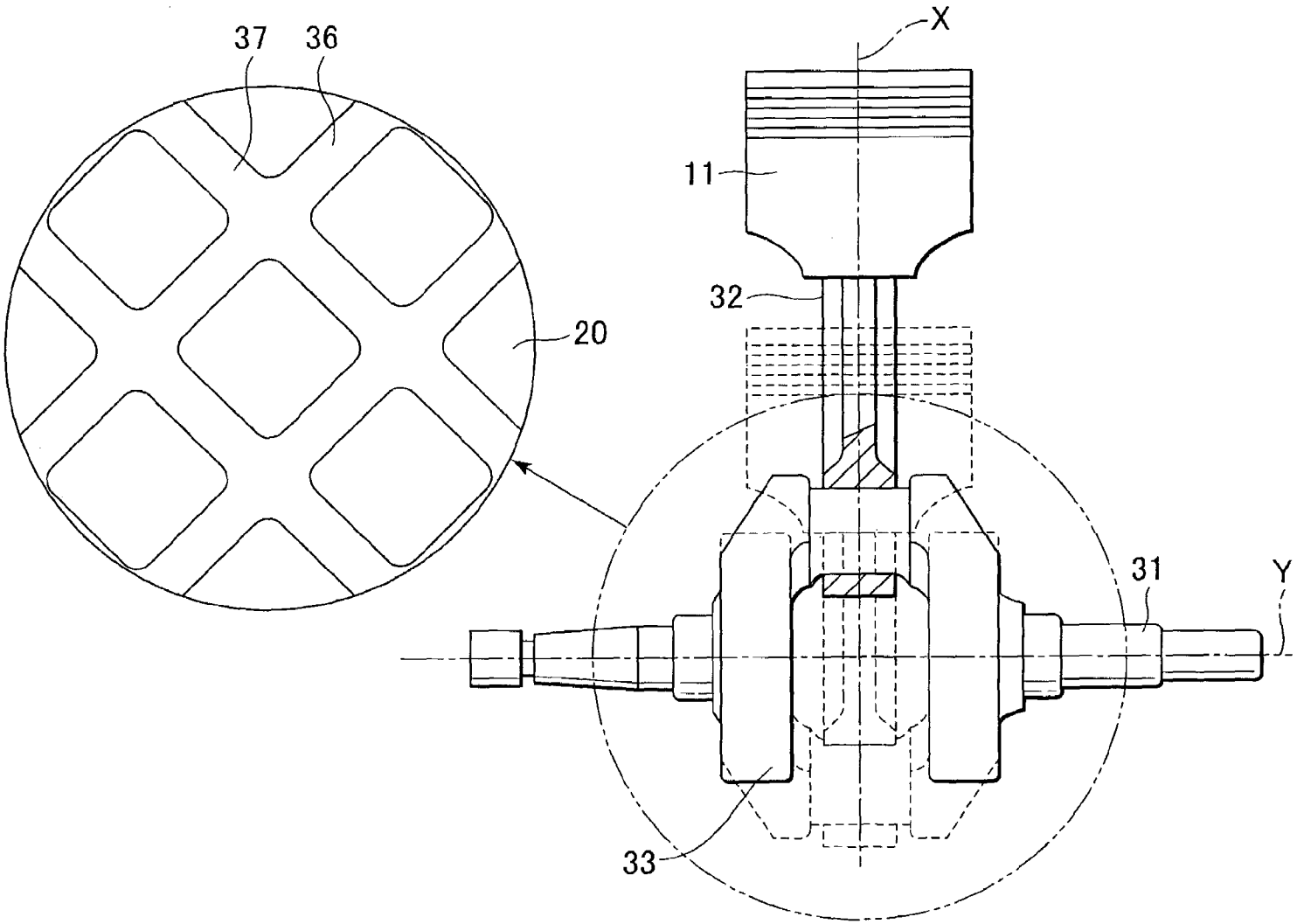
FIG. 4 is an explanatory view for showing the effect of the crankcase to the movement of piston, connecting rod, and crankshaft.
Figure 5A:
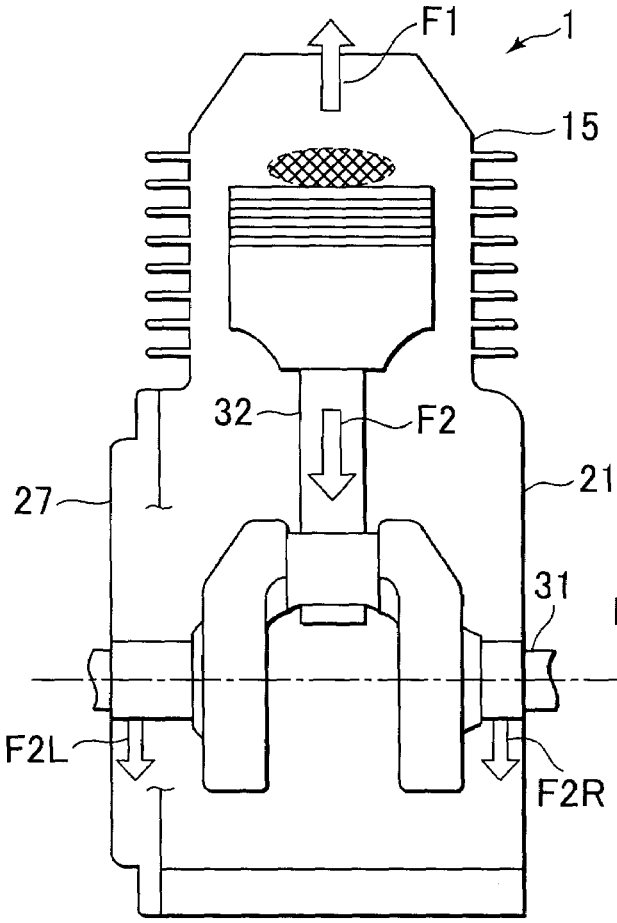
FIG. 5A is an explanatory view for showing the power affecting an engine.
Figure 5B:
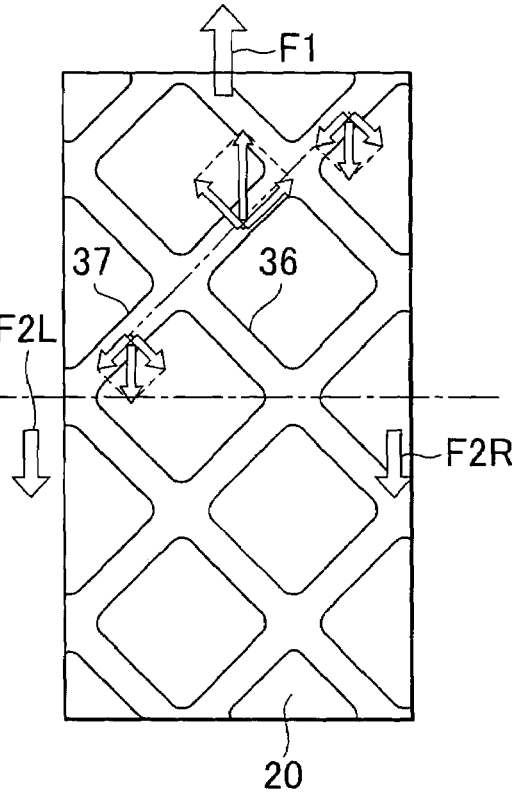
FIG. 5B is a development view for showing the power transmitting state through ribs.

An embodiment of the present invention will be described in detail with reference to the accompanying drawings. Each drawing relates to the embodiment of the present invention. FIG. 1 is a configuration view of a crankcase with a bearing cover removed, FIG. 2 is a top view of a crankcase with a bearing cover attached, FIG. 3 is a one side view of a crankcase with a bearing cover attached, FIG. 4 is an explanatory view for showing the effect of the crankcase to the movement of piston, connecting rod, and crankshaft, FIG. 5A is an explanatory view for showing the power affecting an engine, and FIG. 5B is a development view for showing the power transmitting state through ribs.

An engine of the present embodiment is a single cylinder four-stroke utility engine used for various purposes such as generator, operation machine, and snowmobile.

As shown in FIG. 1, an engine 1 has a cylinder block 5 comprising cylinder 6 and crankcase 7, which is cast from metal such as aluminum, iron or the like.

A cylinder liner 10 is integrally cast inside the cylinder 6, and a piston 11 is slidably inserted in this cylinder liner 10. A cylinder head 15 is capped on the top of the cylinder 6. A combustion chamber 12 is formed between the cylinder head 15 and the piston 11. Moreover, a rocker cover 16 is capped on the top of the cylinder head 15. A rocker room, as not shown, is formed between the cylinder head 15 and the rocker cover 16, an intake valve and an exhaust valve are driven by a valve operating mechanism stored in the rocker room, and the combustion chamber 12 is opened or closed on a predetermined timing.

A crankcase 7 comprises mainly a skirt part 20 connected to a lower part of cylinder 6, a side wall 21 closing one side of the skirt part 20, and a base 22 connected to the lower part of the skirt part 20 and the lower part of the side wall 21.

An opening 20*a* for accommodating a crankshaft 31 or the like in the crankcase 7, described below, is formed on the other side of the skirt part 20. Along the opening 20*a*, a series of an abutting surface 25 is formed circularly on the other side of the skirt part 20 and base 22. Several joint parts 26 having fastener holes 26*a* are provided on the abutting surface 25. The crank chamber 30 is formed in the crankcase 7 by abutting a bearing cover 27 on the abutting surface 25 (see the FIG. 2, 3) for closing the opening 20*a* and by fastening the bearing cover 27 with bolts 28 through each joint part 26.

The bearings 21*a*, 27*a* are provided on the approximate center parts of the side wall 21 and the bearing cover 27 respectively, and face each other. Both ends of crankshaft 31 accommodated in the crank chamber 30 are rotatably supported by the bearings 21*a*, 27*a*. In the crank chamber 30, a big end 32*a* of a connecting rod 32 connected to the piston 11 rotatably connects to the crankshaft 31. Moreover, a pair of balancers 33 is provided on the both sides of the connecting rod 32. A scraper 34 is fixed on the big end 32*a* of the connecting rod 32. When the engine 1 operates, the scraper 34 draws up oil pooled in the crank chamber 34 and such oil lubricates the cylinder liner 10, the crankshaft 31 and other parts required to be lubricated such as an unillustrated camshaft.

As shown in FIG. 2, 3, several stiffening ribs 36, 37, inclined at a predetermined angle to an axial of the crankshaft 31, are provided on an outer surface of the skirt part 20 formed in the circumferential direction of the crankshaft 31 (i.e. in a direction approximately perpendicular to the crankshaft 31).

Concretely speaking, on the embodiment of the present invention, each stiffening rib 36 is inclined at a predetermined elevation angle (e.g. approximately 45 degrees elevation angle) to the axial of the crankshaft and extends from one side of the skirt part 20 to the other side of skirt part 20 at equal intervals. On the other hands, each stiffening rib 37 is inclined at a predetermined depression angle (e.g. approximately 45 degrees depression angle) to the axial of the crankshaft and extend from one side of the skirt part 20 to the other side of skirt part 20 at equal intervals. Therefore, as shown in FIG. 4, on the embodiment of the present invention, each stiffening rib 36, 37 are inclined at 45 or 135 degrees angle (approximately 45 or 135 degrees angle) to a rotational axis Y of the crankshaft 31 and a actuating axis X of the piston 11 and are arranged in lattice. Moreover, it is possible to provide these stiffening ribs 36, 37 on the inner surface of the skirt part 20.

As shown here as FIG. 3, it is preferable that at least one end portion of either the stiffening ribs 36 or the stiffening ribs 37 is set at the same position as the joint part 26 formed on the other side of the skirts part 20 which is connected to the bearing cover 27. Moreover, it is more preferable that an intersection point of one end of the stiffening ribs 36 and the stiffening ribs 37 is set at the same position as the joint part 26.

In the present embodiment, for example, as shown in FIG. 5A, when a force F1 heading toward the cylinder head 15 of the engine 1 and a reaction force F2 heading toward the piston 11 are generated by an explosion power generated in the combustion chamber 12, the force F1 transmits from the upper part of the crankcase 7 to the skirt part 20 through the cylinder 6 or the like. On the other hand, the reaction force F2 is divided into the forces F2L, F2R by crankshafts, and each force F2L, F2R transmits from the right and left side of the crankcase 7 to the skirt part 20 through the side wall 21 and the bearing cover 27. Each force F1, F2L, and F2R transmitted to the skirt part 20 is mainly dispersed on the all surface of the skirt part 20 through the stiffening ribs 36, 37. At this time, each stiffening rib 36, 37 inclined to the crankshaft 31 causes the force component operating in the width direction of each stiffening rib 36, 37 to be decreased, and such force component is dispersed along the extending direction of each stiffening rib 36, 37 effectively. Consequently, the skirt part 20 does not bend, because all stiffening ribs 36, 37 accept each force F1, F2L, and F2R. Though the force operated on the stiffening ribs 37 is shown in the FIG. 5B as one example, the force operated on stiffening ribs 36 is dispersed in the same way.

In the present embodiment, since the skirt part 20 has several stiffening ribs 36, 37 inclined to an axial of the crankshaft 31 at a predetermined degrees angle, an impact of explosion transmitted to the crankcase 7 through the crankshaft 31, can be efficiently dispersed by the skirt part 20 so as to improve a stiffness of the crankcase 7.

Consequently, it is possible to reduce a thickness of the crankcase 7 and to achieve a weight reduction of the crankcase 7 with a required stiffness kept.

Especially in this case, an impact of explosion force transmitted to the crankcase 7 can be more effectively dispersed by the skirt part 20 having the stiffening ribs 36, 37 arranged in lattice, and the stiffness of crankcase 7 further improves.

Moreover, since the end portions of the stiffening ribs 36, 37 are provided at the same position as the joint part 26, an impact transmitted from the crankshaft 31 to the crankcase 7 through the bearing cover 27 can be disperse more efficiently.

It is possible to set a cross-section shape, height, and width of the stiffening ribs 36, 37 freely based on the required stiffness of the crankcase 7.

While the description above refers to particular embodiments of the present invention, it will be understood that many modifications may be made without departing from the spirit thereof. The embodiments include various stages of the invention, and various inventions may be extracted by proper combinations of the disclosed requirements.

For example, if several constituent requirements are deleted from all constituent requirements disclosed in the embodiments, problems to be solved by the invention can be also solved, and effects as mentioned herein can be obtained, and in these cases such constitutions omitting some of the constituent requirements are also realized as different forms of the invention.

What is claimed is:

1. A crankcase of an engine having a crankshaft therein, comprising:

a skirt part formed in a circumferential direction of the crankshaft; and plural stiffening ribs provided on a wall surface of the skirt part as inclined at a predetermined degree angle to the axis of the crankshaft, said predetermined degree angle having a non-zero vertical component perpendicular to said crankshaft and a non-zero horizontal component parallel to said crankshaft, wherein a stiffening rib in said plural stiffening ribs extends from a first side of the skirt part to a second side of the skirt part.

2. The crankcase of an engine according to claim 1, wherein the stiffening ribs are provided on the wall surface of the skirt part in different directions than each other, and are arranged in a lattice.

3. The crankcase of an engine according to claim 1, wherein said stiffening ribs are inclined at an elevation angle of approximately 45 degrees to an axis of said crankshaft.

4. The crankcase of an engine according to claim 1, wherein said stiffening ribs are inclined at a depression angle of approximately 45 degrees to an axis of said crankshaft.

5. The crankcase of an engine according to claim 1, wherein said stiffening ribs extend from said first side of said skirt part to said second side of said skirt part at equal intervals.

6. The crankcase of an engine according to claim 1, wherein said stiffening ribs are disposed on an outer surface of said skirt part.

7. A crankcase of an engine having a crankshaft therein, comprising:

a skirt part formed in a circumferential direction of the crankshaft;

plural stiffening ribs provided on a wall surface of the skirt part as inclined at a predetermined degree angle to the axis of the crankshaft, said predetermined degree angle having a non-zero vertical component perpendicular to said crankshaft and a non-zero horizontal component parallel to said crankshaft; and a joint part provided on one side of the skirt part for connecting the skirt part with a bearing cover supporting the crankshaft, wherein an end of the stiffening rib is set at a same position as the joint part.

8. A crankcase of an engine having a crankshaft therein, comprising:

a skirt part formed in a circumferential direction of the cranksbaft;

plural stiffening ribs provided on a wall surface of the skirt part as inclined at a predetermined degree angle to the axis of the crankshaft, said predetermined degree angle having a non-zero vertical component perpendicular to said crankshaft and a non-zero horizontal component parallel to said crankshaft; and a joint part provided on one side of the skirt part for connecting the skirt part with a bearing cover supporting the crankshaft, wherein an end of the stiffening rib is set at a same position as the joint part.

9. The crankcase of an engine according to claim 8, wherein an intersection point of the end of the stiffening ribs arranged in the lattice is set at the same position as the joint part.

10. A crankcase of an engine having a crankshaft therein, comprising:

a skirt part formed in a circumferential direction of the crankshaft; and plural stiffening ribs provided on a wall surface of the skirt part as inclined at a predetermined degree angle to the axis of the crankshaft, said predetermined degree angle having a non-zero vertical component perpendicular to said crankshaft and a non-zero horizontal component parallel to said crankshaft, wherein the crankcase comprises a circularly abutting surface, said circularly abutting surface comprising fastener holes.

11. The crankcase of an engine according to claim 10, further comprising a bearing cover abutted on said abutting surface.

12. A crankcase of an engine having a crankshaft therein, comprising:

a skirt part formed in a circumferential direction of the crankshaft; and plural stiffening ribs provided on a wall surface of the skirt part as inclined at a predetermined degree angle to the axis of the crankshaft, said predetermined degree angle having a non-zero vertical component perpendicular to said crankshaft and a non-zero horizontal component parallel to said crankshaft, wherein said stiffening ribs are disposed on an inner surface of said skirt part.

13. A crankcase of an engine having a crankshaft therein, comprising:

a skirt part formed in a circumferential direction of the crankshaft;

a first set of stiffening ribs; and a second set of stiffening ribs, wherein said first set of stiffening ribs and said second set of stiffening ribs are provided on a wall surface of the skirt part inclined at a predetermined degree angle to an axis of the crankshaft, wherein said predetermined degree angle has a non-zero vertical component perpendicular to said crankshaft and a non-zero horizontal component parallel to said crankshaft, and wherein a stiffening rib in said first set of stiffening ribs and said second set of stiffening ribs extends from a first side of the skirt part to a second side of the skirt part at equal intervals.

14. The crankcase of an engine according to claim 13, wherein said first set of stiffening ribs are perpendicular to said second set of stiffening ribs.

15. The crankcase of an engine according to claim 13, wherein said first set of stiffening ribs are inclined at an elevation angle of approximately 45 degrees to the axial of said crankshaft.

16. The crankcase of an engine according to claim 13, wherein said second set of stiffening ribs are inclined at a depression angle of approximately 45 degrees to the axial of said crankshaft.

17. The crankcase of an engine according to claim 13, wherein said first set of stiffening ribs are provided on the wall surface of the skirt part in a different direction than said second set of stiffening ribs.

18. The crankcase of an engine according to claim 13, wherein said first set of stiffening ribs and said second set of stiffening ribs form a lattice.

19. An engine comprising:

a crankshaft, wherein said crankcase comprises:

a skirt part formed in a circumferential direction of the crankshaft;

a first set of stiffening ribs; and a second set of stiffening ribs, wherein said first set of stiffening ribs and said second set of stiffening ribs are provided on a wall surface of the skirt part inclined at a predetermined degree angle to an axis of the crankshaft, wherein said predetermined degree angle has a non-zero vertical component perpendicular to said crankshaft and a non-zero horizontal component parallel to said crankshaft, and wherein a stiffening rib in said first set of stiffening ribs and said second set of stiffening ribs extends from a first side of the skirt part to a second side of the skirt part at equal intervals.

* * * * *